US008047760B2

(12) United States Patent
Roan et al.

(10) Patent No.: US 8,047,760 B2
(45) Date of Patent: Nov. 1, 2011

(54) INTEGRAL POWER OR ELECTRICAL CONDUIT COUPLER

(75) Inventors: Thomas Roan, Fargo, ND (US); Travis Mackey, Gwinner, ND (US); Lance Kistner, Sabin, MN (US); Rodney Koch, Mooreton, ND (US)

(73) Assignee: Clark Equipment Company, West Fargo, ND (US)

( * ) Notice: Subject to any disclaimer, the term of this patent is extended or adjusted under 35 U.S.C. 154(b) by 338 days.

(21) Appl. No.: 12/251,945

(22) Filed: Oct. 15, 2008

(65) Prior Publication Data

US 2010/0092233 A1 Apr. 15, 2010

(51) Int. Cl.
*B66C 23/00* (2006.01)

(52) U.S. Cl. ..... 414/723; 414/686

(58) Field of Classification Search ..... 414/723, 414/686; 280/420, 421, 422, 507
See application file for complete search history.

(56) References Cited

U.S. PATENT DOCUMENTS

| | | | | |
|---|---|---|---|---|
| 3,243,066 | A * | 3/1966 | Gardner et al. | 414/698 |
| 4,017,136 | A * | 4/1977 | Sasgen | 439/503 |
| 5,176,491 | A | 1/1993 | Houkom | 414/694 |
| 5,806,313 | A | 9/1998 | Koshi et al. | 60/458 |
| 5,957,213 | A | 9/1999 | Loraas et al. | |
| 6,171,050 | B1 | 1/2001 | Johnson | 414/685 |
| 6,301,811 | B1 | 10/2001 | Gilmore | |
| 6,360,516 | B1 | 3/2002 | Harkcom et al. | 56/15.5 |
| 6,378,279 | B1 | 4/2002 | Smith et al. | 56/15.5 |
| 6,409,457 | B1 | 6/2002 | Korycan et al. | 414/501 |
| 6,481,192 | B1 | 11/2002 | Harkcom et al. | 56/10.8 |
| 6,625,964 | B2 | 9/2003 | McLeod et al. | 56/11.9 |
| 6,672,568 | B1 | 1/2004 | Rawlinson | 254/323 |
| 6,708,911 | B2 | 3/2004 | Patterson et al. | 241/101.762 |
| 6,711,884 | B1 | 3/2004 | McLeod et al. | 56/14.9 |
| 6,796,762 | B2 | 9/2004 | Vicars, III et al. | 414/685 |
| 6,918,850 | B2 | 7/2005 | Hasegawa et al. | 475/72 |
| 6,994,511 | B2 * | 2/2006 | Westendorf et al. | 414/686 |
| 6,997,667 | B2 | 2/2006 | Hackett et al. | 414/685 |
| 7,036,622 | B2 | 5/2006 | Iwaki | 180/311 |
| 7,066,417 | B2 | 6/2006 | Lepage et al. | 241/101.762 |

(Continued)

FOREIGN PATENT DOCUMENTS

CN CA 2638121 2/2009

(Continued)

OTHER PUBLICATIONS

Notification of Int'l Search Report, dated Dec. 9, 2009 for Int'l Appln. No. PCT/US2009/059942.

(Continued)

*Primary Examiner* — Donald Underwood
(74) *Attorney, Agent, or Firm* — John D. Veldhuis-Kroeze; Westman, Champlin & Kelly, P.A.

(57) ABSTRACT

A conduit connector assembly for attachments on a loader includes a mounting plate with at least one coupler section mounted on the plate and secured rigidly to a forward end of one of the lift arms of a loader. The coupler section or sections are connected with conduits to power or electrical signal sources on the loader. The coupler section or sections on the lift arm are connectable to mating coupler sections attached to conduits from an attachment that requires power and/or control signals for operation. The coupler sections are supported to one side of the lines of vision that an operator in an operator's cab of the loader needs for watching the attachment.

13 Claims, 6 Drawing Sheets

U.S. PATENT DOCUMENTS

| | | | | |
|---|---|---|---|---|
| 7,156,333 | B2 | 1/2007 | Lepage et al. | 241/101.763 |
| 2002/0130547 | A1 | 9/2002 | Dvorak et al. | |
| 2004/0016586 | A1 | 1/2004 | Dvorak et al. | |
| 2005/0184510 | A1 | 8/2005 | Langenfeld et al. | |
| 2006/0120848 | A1 * | 6/2006 | Guhr | 414/723 |

FOREIGN PATENT DOCUMENTS

| | | |
|---|---|---|
| FR | 2886372 | 12/2006 |
| JP | 50-122106 | 10/1975 |
| JP | 55-126362 | 9/1980 |
| WO | WO 2006036104 | 4/2006 |
| WO | WO 2009088462 | 7/2009 |

OTHER PUBLICATIONS

Written Opinion of the Int'l Searching Authority for Int'l Appln. No. PCT/US2009/059942.

Paper Attached "Comments Relating to Foreign References Cited in International Search Submitted With Information Disclosure Statement Filed on Jan. 5, 2010".

English abstract of French Patent No. FR2886372, which was cited in an IDS of Jan. 5, 2010.

Statement Explanation of Showing of Bobcat Back Hoe Manual.

Operation & Maintenance Manual 8811 Backhoe, Bobcat Company, 2009, pp. 1 and 47.

* cited by examiner

INTEGRAL POWER OR ELECTRICAL CONDUIT COUPLER

BACKGROUND OF THE DISCLOSURE

The present disclosure relates to a conduit coupler or connector mounted on a moving structure, such as the lift arms on a loader, wherein the couplers for power or signal lines leading to power equipment attached to the lift arms are housed within a main structural member, such as one of the lift arms, and the conduit couplers are permanently placed in a position where they do not block or impair the operator view of the powered attachment, and where they are protected from damage. Typical conduit couplers are for hydraulic pressure lines or hoses, electrical control signals and electrical power for compact loader attachments.

Power attachments that require power to operate, such as hydraulic fluid under pressure, are commonly used on loaders, and in order to couple the hydraulic conduits or lines for the attachment to the hydraulic system of the loader, known quick couplers are generally utilized. The attachments are removable between uses, so connecting and disconnecting the two mating sections of power quick couplers is necessary. The positioning of the power carrying lines and the quick couplers can interfere with viewing the attachment by the loader operator. The hydraulic line and electrical couplers that have been utilized in the past for loader attachments have been generally positioned between the lift arms.

Power attachments that require remote hydraulic power include those which use hydraulic motors, such as power augers, rotary brush cutters, mower, and the like, or require the use of hydraulic actuators, including tree spades, grapples, various compactors, and the like. Mounting the coupler components or sections (half of a male/female pair) that are carried on the power vehicle or loader in a fixed location simplifies connecting and disconnecting, and ensures that the couplers are properly located to aid in reducing visual obstructions.

SUMMARY OF THE DISCLOSURE

The present disclosure relates to mounting position of couplers that are used for connecting conduits from a source of signals or power on a power machine that has a moveable member such as a lift arm on a loader, with conduits, lines or hoses leading to remote attachments requiring power and/or controlled by remote control signals. Conduit couplers or connectors, whether quick attach hydraulic line couplers or electrical connectors as shown herein, have two coupler components or coupler sections, that interfit to complete the conduit connection. Coupler sections for power carrying lines are mounted onto a plate and secured in a desired fixed location on the moveable member of the power machine, such as the lift arm of a loader. The coupler sections are retained in this position both during use and when disconnected from the powered attachment.

The coupler sections are shown on the loader arm as one component (either male or female) of standard quick hydraulic couplers, and of a multiple pin electrical control signal and electric power connector, but other types of connectors for connecting conduits carrying signals and/or power can be used. The coupler sections are positioned such that they are out of the field of vision needed by an operator of the power equipment to observe the powered attachment. The positioning is to minimize blocking the operator's view of the powered attachment. Routing of the hydraulic hoses, electric wires or other conduits is simplified in the form shown and the conduits are protected from external abrasion and forces by mounting them on the interior of a tubular moveable lift arm.

The machine power take off and control signal coupler sections are thus securely mounted and easily used.

DETAILED DESCRIPTION OF PREFERRED EMBODIMENTS

Figure 1:
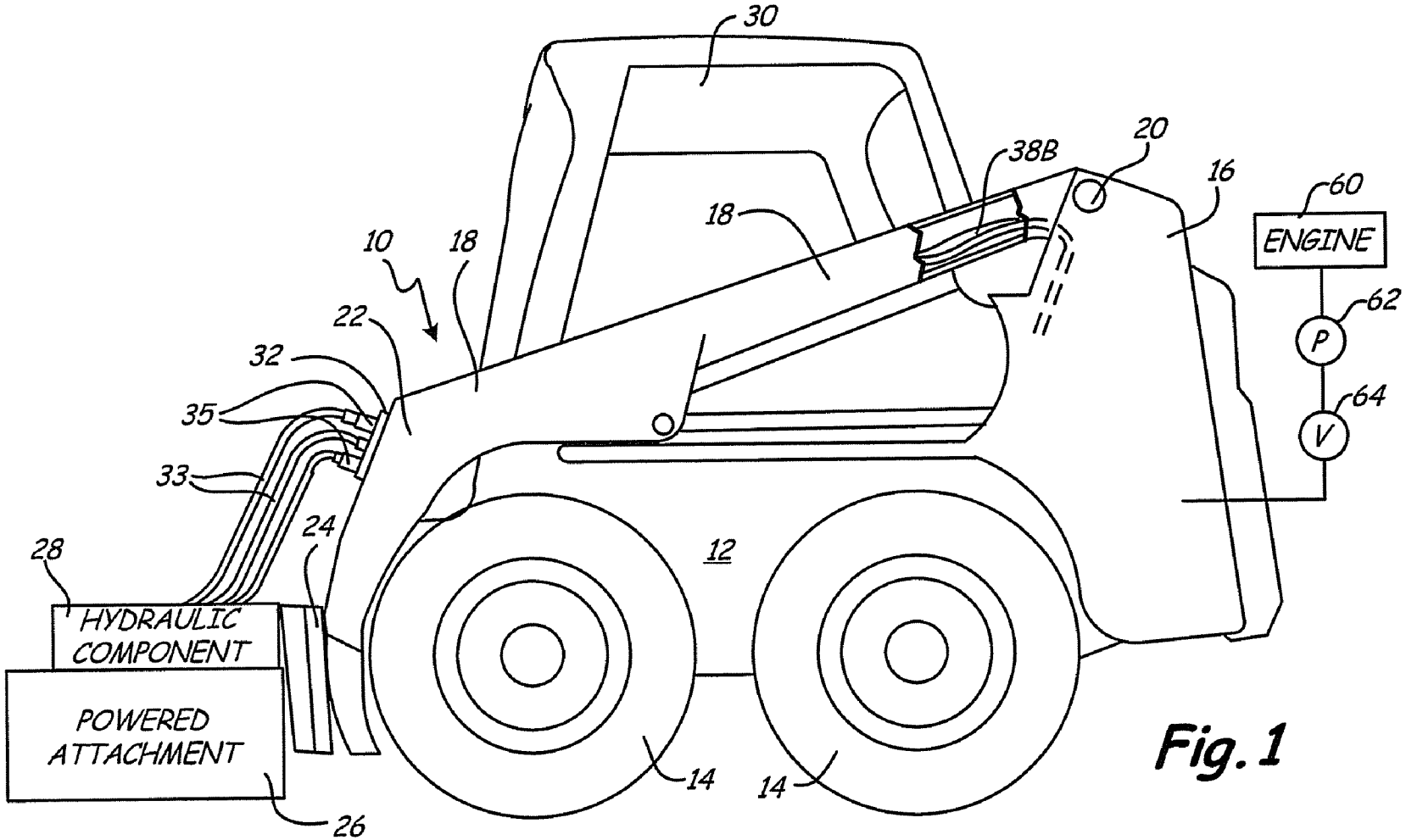
FIG. 1 is a side elevational view of a typical loader having conduit coupler sections mounted according to the present disclosure.
Figure 2:
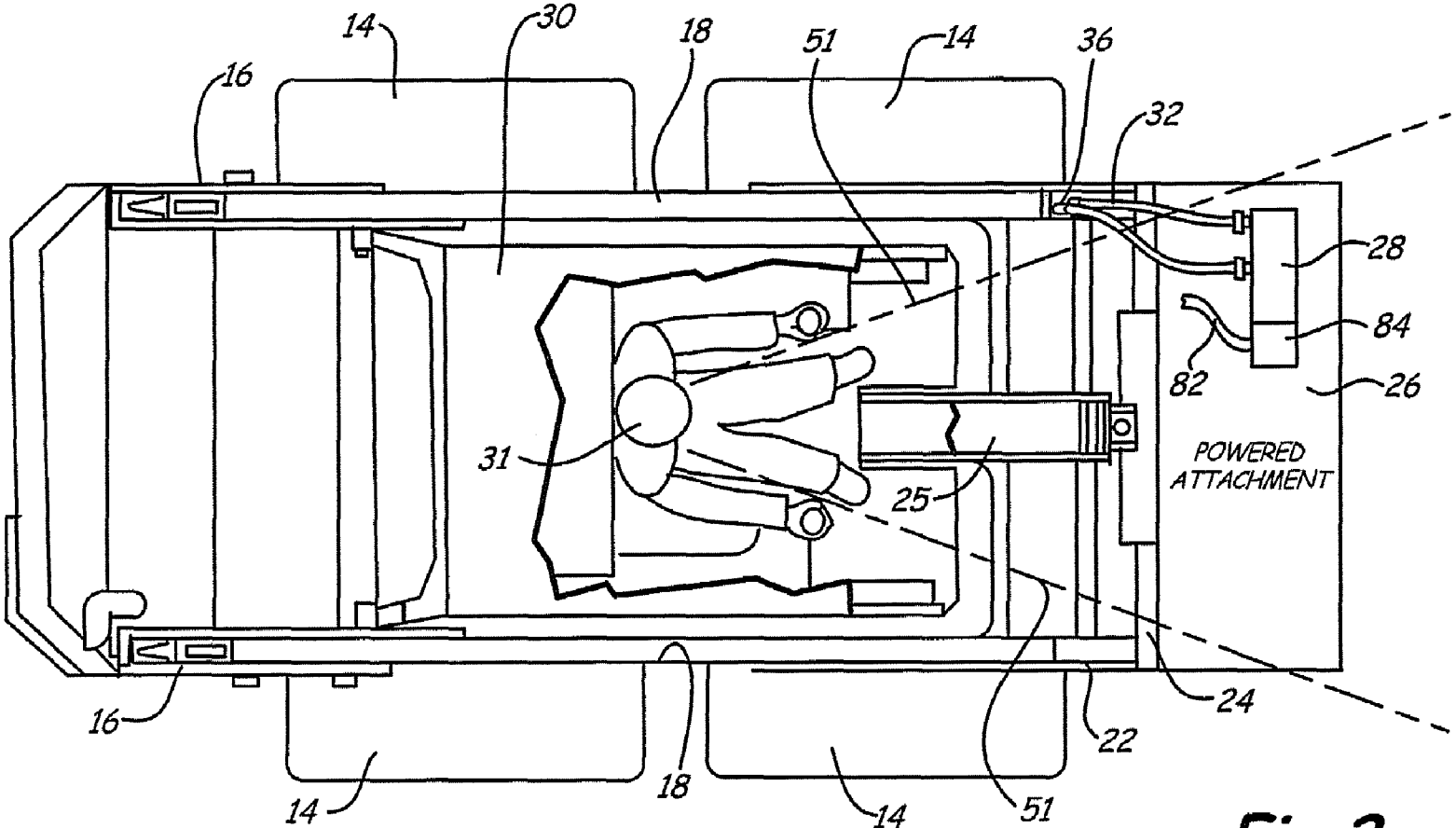
FIG. 2 is a schematic top plan view of a loader.

In FIGS. 1 and 2, a power machine, as shown a loader 10, has a main loader frame 12 for mounting wheels 14 for moving the loader over the ground. The loader frame 12 includes upright supports 16 on which a pair of lift arms 18 are pivotally mounted on pivots 20. The lift arms 18 extend forwardly and downwardly and have forward end portions 22. The forward end portions 22 extend downwardly and mount a tilting attachment plate 24 that as shown, mounts various removable attachments represented schematically as a powered attachment 26. The attachment plate 24 is pivoted about its mounting pivot with a tilt cylinder 25. The powered attachment 26 includes a hydraulic drive component 28 that requires hydraulic fluid under pressure (called hydraulic power) from the hydraulic system of the loader 10. An operator's cab 30 is provided and is mounted between the lift arms 18, in a conventional manner. An operator shown schematically at 31 in FIG. 2 controls the operation of the powered attachment 26. In order to do this, the forward visibility or field of vision of the operator is of importance, and obstructions to visibility that block observation of the powered attachment are undesirable.

The forward, downwardly extending portions 22 of the lift arms have a forward surface 32, and in this form of the disclosure, a coupler assembly 34 is mounted against a reinforcing plate 48 secured on the forward surface 32 of the movable member or lift arm 18. The coupler assembly 34 includes a mounting plate 36 as shown, and a plurality of coupler sections mounted thereon. As shown, the couplers on plate 36 include a male hydraulic coupler section 38, a female hydraulic coupler section 40, and a male auxiliary coupler section 42 mounted thereon. The coupler sections are secured to the mounting plate 36. Remote conduits or lines 33 from the hydraulic component 28 have coupler sections shown generally at 35 that mate with and connect to the coupler sections on the mounting plate 36. One conduit 33 has a female coupler section connectable to the male coupler section 38 and another conduit has a male coupler section that connects to the female coupler section 40. On a rear side of the mounting plate 36, each of the coupler sections includes threaded connections shown in FIG. 3, at 38A, 40A, and 42A.

The connections 38A, 40A and 42A connect to threaded ends of conduits in the form of hydraulic hoses 38B, 40B and 42B that carry hydraulic fluid under pressure from a source, such as a pump 62. The conduits 38B, 40B, and 42B are positioned inside a tubular lift arm 18. The lift arm is a hollow arm that has an internal passageway 44. The conduits 38B, 40B and 42B extend along the length of the passageway 44 and enter the passageway at a base end of the lift arm (near the pivot connections 20 of the lift arm 18 to an upright support 16) through a provided opening, with enough slack in the conduits to permit the lift arms to move about their mounting pivots between lowered and raised positions without stretching or kinking the conduits.

The lift arms 18 shown on the loader of FIG. 1 are arms that move about a radius at the pivot 20, but other loaders and moveable elements can have jointed lift arms, such as those shown in U.S. Pat. No. 6,866,466. In such an instance, the conduits are placed into the lift arms on a forward side of the pivot between the two links forming the lift arms. Again, sufficient slack in the conduits is provided so that the arms can move in the path of movement between lowered and raised positions without damaging the conduits.

Figure 6:
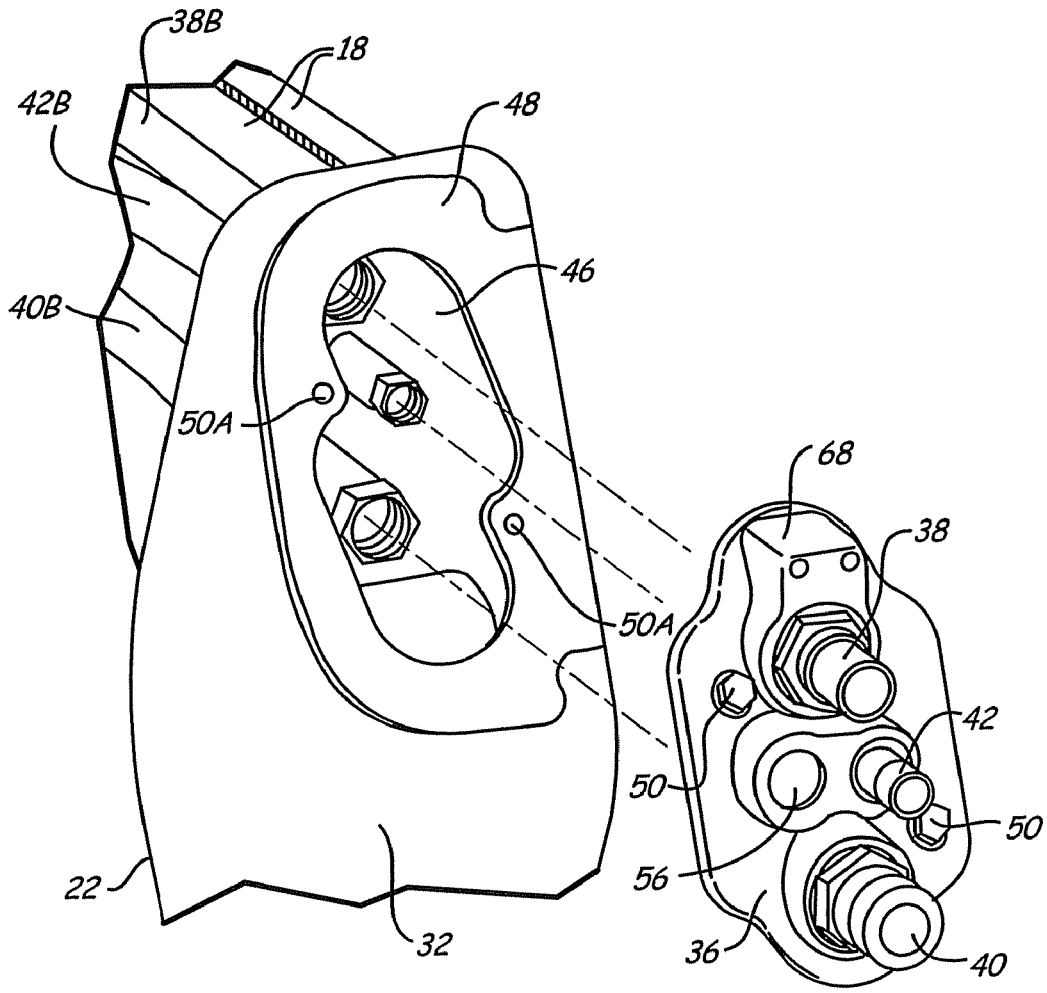
FIG. 6 is an exploded front perspective view showing the conduit coupler sections in position to be mounted to internal power carrying lines.

As shown, in FIG. 6 for example, the mounting plate 36 and the coupler sections 38, 40 and 42 can be separately assembled, and then the conduits in the lift arm are pulled outwardly through a provided opening 46 in the front surface 32 of the forward arm portion 22 of the lift arm for connecting the threaded conduit connections.

A reinforcing plate 48 is welded in place on the front surface 32 of the forward arm portion 22, and the opening 46 passes through the reinforcing plate 48 as well. When the conduits are attached to the coupler sections, the mounting plate 36 can be secured to the reinforcing plate 48 with suitable capscrews or other methods of retention shown at 50. If capscrews are used they can thread into bores 50A on the reinforcing plate 48.

The conduits on the interior of the moving structural member or lift arm 18 are secured as needed, and are protected from outside forces. Additionally, the mounting plate 36 is secured rigidly to the lift arm, so that the conduit coupler sections on plate 36 do not shift or move relative to the lift arm, and are in a location that minimizes the visual obstruction of the powered attachment. A field of vision for the operator of the powered attachment is represented by lines 51 in FIG. 2, and mounting the coupler sections on one of the lift arms moves the coupler sections laterally of this desired field of vision.

The coupler sections 38 and 40 are joined to standard mating coupler sections 35 on lines 33 of the powered attachment and are used for carrying hydraulic fluid under pressure and return fluid from the hydraulic motor or other component being powered. Coupler section 42 can be used for connecting to other conduits or lines, such as a drain line for a "connect under pressure" feature that is now in use for hydraulic couplers to allow a small amount of oil to escape for ease of connection of the couplers. Coupler section 42 also can be used to provide a low back pressure drain line for use with high speed hydraulic motors, for example, motors used on mower attachments. On those attachments a remote conduit or hose is connected through the coupler section 42 to route drain oil through this coupler.

Figure 7:
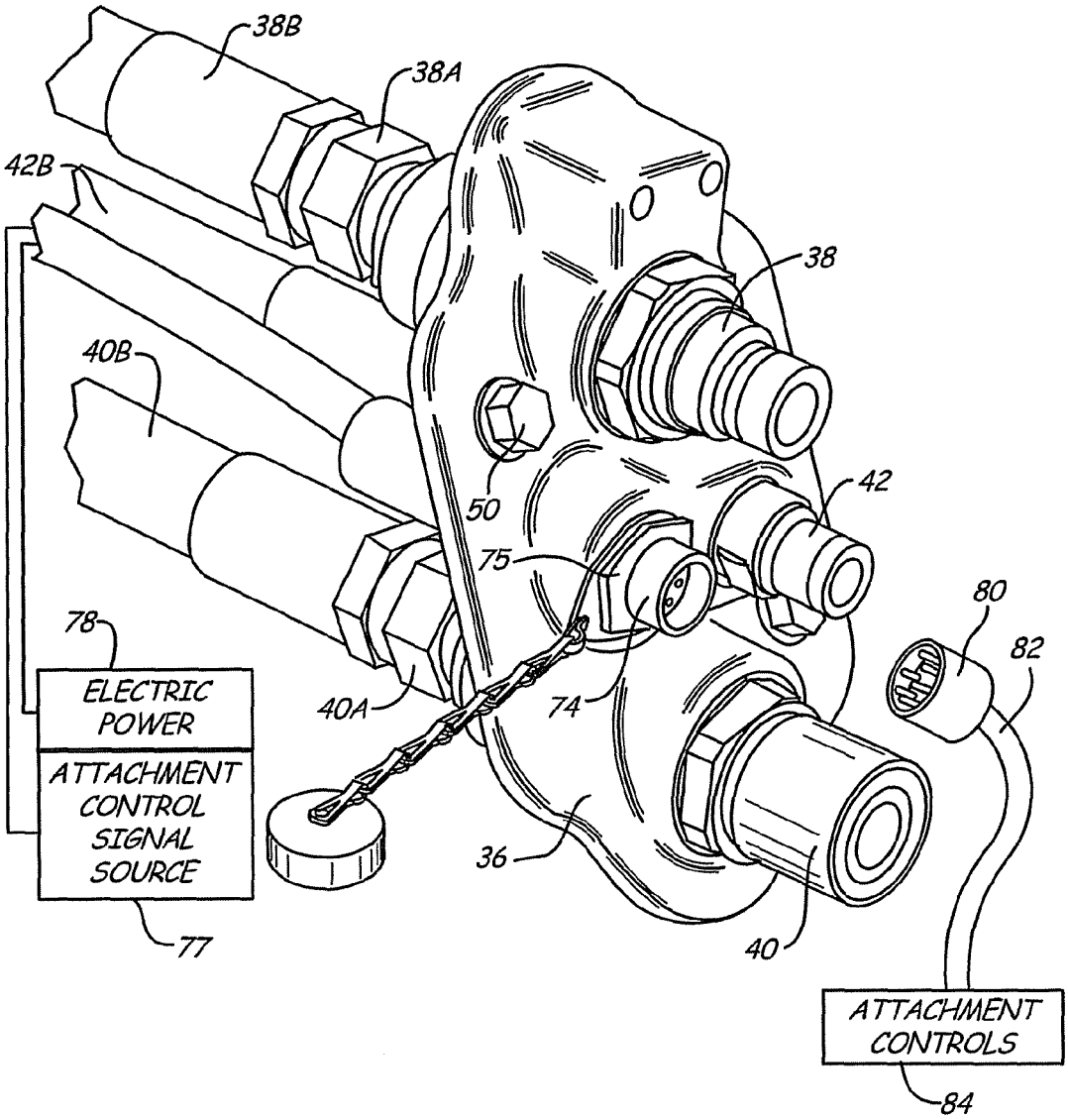
FIG. 7 is a front perspective view similar to FIG. 4 showing a modified mounting including a conduit coupler for electrical signals and power added to the showing of FIG. 4.

It can be seen that the mounting plate 36 also has an extra opening indicated at 56, which in the from shown in FIG. 7 is used for mounting a coupler section for a conduit carrying electrical signals and power to an attachment.

In FIG. 1, a typical hydraulic source is illustrated schematically. A loader engine indicated schematically at 60 drives a pump 62, and a valve 64 is used for controlling hydraulic fluid under pressure to and from the conduits 38B and 40B. Other conventional valves are used for the tilt cylinders, and for the cylinders that raise and lower the lift arms.

The mounting plate 36 and the attached coupler sections can be recessed into the forward end of a lift arm or movable element, by placing a larger opening in the front wall of the forward end section of the lift arm, and mounting a support plate on an interior of the lift arm. Suitable access openings can be provided for connecting the hydraulic conduits to the coupler sections that are mounted in the recess in the arm.

Figure 3:
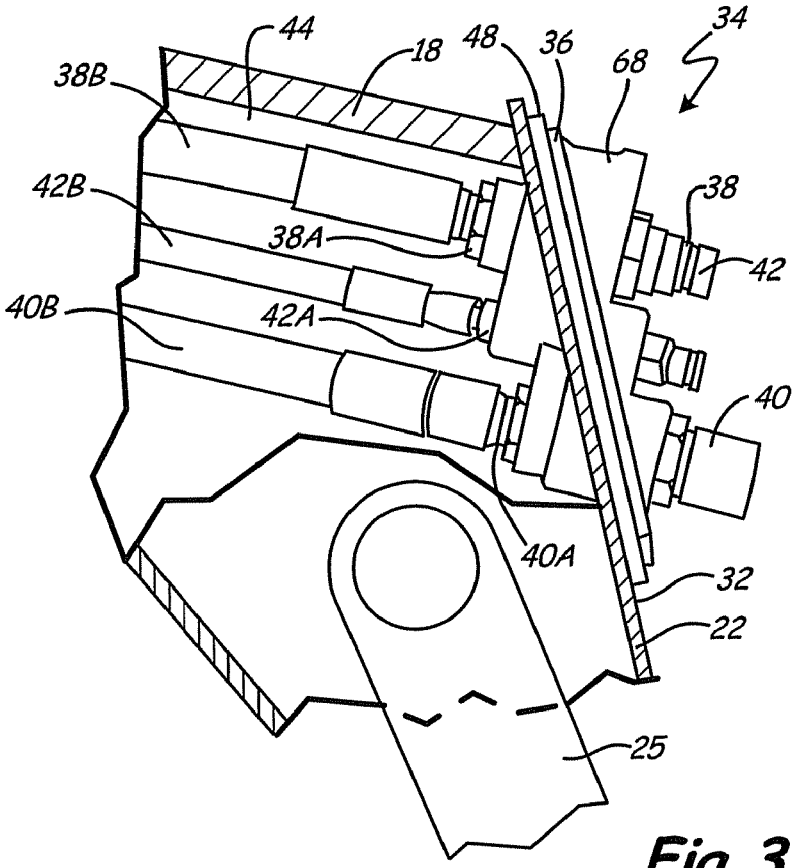
FIG. 3 is an enlarged fragmentary sectional view of a lift arm showing the mounting of the conduit coupler sections according to the present disclosure.
Figure 4:
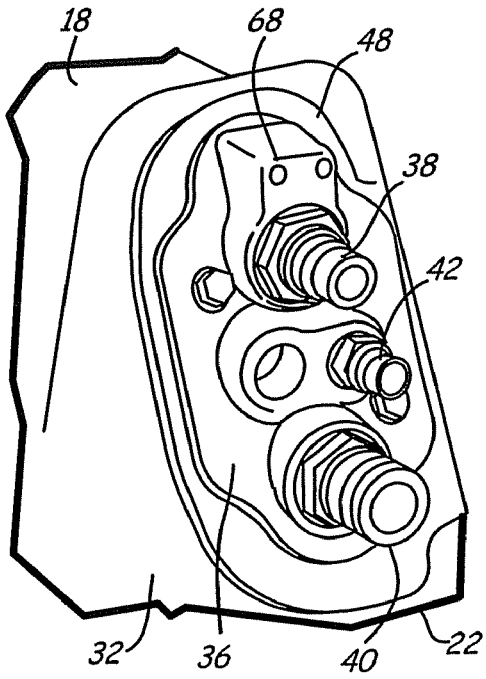
FIG. 4 is a front perspective view of the showing of FIG. 2.
Figure 5:
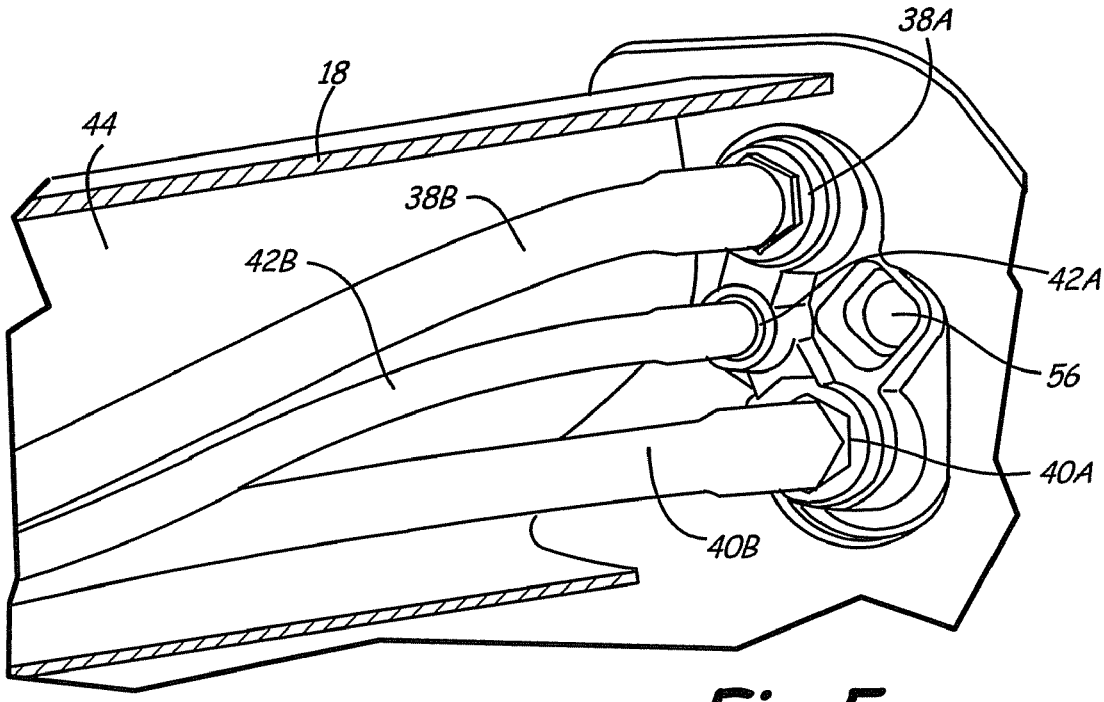
FIG. 5 is a rear perspective view of the mounting of the coupler sections of FIG. 4.

The reinforcing plate 48 can be used for supporting a cover over the coupler section. Additionally, the mounting plate 36, in the form shown, has a boss member 68 with threaded bores that can be used for attaching a cover over the coupler sections. As shown in FIG. 3, at the back face of plate 36, bosses 68 of the plate extend through the opening and into the passageway when mounted to the boom or lift arm.

The coupler sections mounted on mounting plate 36 can be tilted up or down, or to the side in order to make attaching mating quick coupler sections easier. Also, mounting the coupler sections on the forward ends of the lift arms positions them close to the powered attachment so the conduits on the power attachment can be kept short.

FIG. 7 shows a modified form of the disclosure wherein mounting plate 36 is mounted onto plate 48 in the same manner as in the first form. The hydraulic pressure carrying coupler sections previously described are shown in place and numbered the same. As shown, a suitable electrical socket 74, which may be a multi pin socket, forming an electrical conduit coupler section, is secured to and supported on plate 36, and extends through opening 56 in the plate 36. The conduit coupler section 74 (one or more coupler sections can be provided) can be secured to the plate 36 is a suitable manner, such as with a nut 75 that is used to clamp the coupler section 74 in place with a flange on the coupler section 74 larger than opening 56 on the back side of the plate 36. The conduit section 74 can be recessed into the arm or can be flush with the outer surface of the plate 36.

An electrical conduit 76, which, when carrying control signals and power may be a wiring harness containing a plurality of electrical wires is coupled to the conduit connector 74. The number of wires in conduit 76 can be selected for carrying the desired control signals and for carrying electrical power. The conduit 76 connects the conduit connector 74 to an attachment control signal source 77 and to an electrical power source 78 on the loader. The control signal source may be circuitry controlled by operator actuated buttons or levers for controlling the attachment. The electrical conduit 76 extends through the lift arm 18 as shown for the hydraulic pressure carrying conduits. A suitable mating electrical connector 80 forms a second conduit coupler section and has a conduit 82 connected to attachment control 84 on the powered attachment 26. The controls can be made and used as described in U.S. Pat. No. 5,957,213 for carrying signals to a powered component on the powered attachment. U.S. Pat. No. 5,597,213 is hereby incorporated by reference. The plug 80 forms a second coupler section mating with the coupler section 74. As with hydraulic conduit couplers, either male or female electrical conduit coupler sections can be mounted on the movable element (lift arm) of the power machine.

The terms coupler and coupler section as used herein include electrical plugs and sockets or receptacles, hydraulic couplers and other power or signal carrying connectors used to transmit signals or power from sources to an attachment Although the present invention has been described with reference to preferred embodiments, workers skilled in the art will recognize that changes may be made in form and detail without departing from the spirit and scope of the invention.

What is claimed is:

1. A power machine having a tubular lift arm that has a longitudinal passageway and an outer end that can be raised and lowered positioned along a side of an operator's location for the power machine, a mount for an attachment on the outer end of said lift arm, the outer end of the lift arm comprising a tubular downwardly extending section having a forwardly facing wall with an aperture formed therein in communication with the longitudinal passageway, a source of at least one of fluid power and electrical signals on the power machine, a conduit leading from the source and positioned within the longitudinal passageway and extending to the tubular downwardly extending section, a mounting plate being secured to the forwardly facing wall of the lift arm and having one or more bosses on a back face of the mounting plate projecting through the aperture and into the longitudinal passageway, and a first conduit coupler section coupled to the mounting plate and projecting forwardly therefrom for receiving a second mating conduit coupler section, the conduit being in communication with the first coupler section via attachment to the mounting plate.

2. The power machine of claim 1, wherein said mounting plate carries a plurality of conduit coupler sections for receiving mating conduit coupler sections from an attachment on the mount.

3. The power machine of claim 1, wherein said power machine comprises a loader having a pair of lift arms that are spaced apart and an operator compartment between the lift arms, said mounting plate being mounted onto one of the lift arms to position the first coupler section to a lateral side of a desired forward field of vision of an operator in the operator's cab.

4. The power machine of claim 3, wherein said conduit extends along a substantial portion of a length of the one of the tubular lift arms from the source to the mounting plate.

5. The power machine of claim 4, wherein said source comprises a hydraulic pump providing fluid under pressure, and a third conduit coupler section mounted onto the mounting plate adjacent the first conduit coupler section, and a pair of conduits within the one tubular lift arm coupled to the first and third conduit coupler sections via attachment to the mounting plate.

6. The power machine of claim 1, wherein the boss is a support boss for mounting a cover to protect the coupler sections.

7. The power machine of claim 1 wherein the source comprises an electrical control signal source and the conduit coupler section comprises an electrical connector.

8. A lift arm assembly for a power loader comprising a lift arm having a tubular portion and a forwardly facing panel at a front end thereof, a conduit coupler assembly for carrying an electrical signal and fluid power from a plurality of conduits through the coupler assembly to an apparatus adjacent the forwardly facing front end panel, said conduit coupler assembly including a mounting plate, a plurality of conduit coupler sections mounted on said mounting plate, the front end panel having an opening through which one or more bosses on a back face of the mounting plate extend, said mounting plate being mounted on a forwardly facing side of the forwardly facing panel and connected to at least one of the plurality of conduits, the plurality of conduits extending through an internal passageway of the lift arm.

9. The conduit coupler assembly of claim 8 wherein said conduit coupler sections comprises a quick coupler section for a hydraulic line mounted on and secured to the mounting plate.

10. A self-propelled loader having a pair of lift arms that are spaced apart and movable about a pivot axis on the loader, the lift arms having internal passageways and outer ends for mounting an attachment requiring at least one of fluid power and control signals for operating the attachment, a source of at least one of fluid power and control signals on the loader, the improvement comprising an outer end of one lift arm having a downwardly extending forwardly facing surface with an aperture formed therein, a mounting plate having a first coupler section secured thereto so that one or more bosses on a back face of the mounting plate extends into the aperture, the mounting plate being secured to the forwardly facing surface so that the first coupler section is in a position for receiving a mating coupler section, and a conduit between the first coupler section and the source on the loader, the conduit extending through the passageway along a length of the one lift arm and being attached to the mounting plate.

11. The loader of claim 10 wherein there is a second coupler section mounted onto the mounting plate adjacent the first coupler section, and the conduit comprises a pair of hydraulic pressure carrying conduits within the longitudinal passage of the one lift arm and connected to the first and second coupler sections via attachment to the mounting plate, respectively.

12. The loader of claim 10 wherein the first coupler section comprises an electrical connector section.

13. A method of providing power or signal carrying couplers on a loader having a pair of lift arms that are spaced apart and on opposite sides of an operator's cab, the lift arms having forward ends for mounting an attachment requiring power or control signals for operating the attachment, the method comprising providing a source of at least one of fluid power and control signals on the loader, coupling a conduit to the source, providing a longitudinal passage in at least one of the lift arms and placing the conduit within the longitudinal passage adjacent a rearward end of the at least one lift arm and extending the conduit through the passage to the forward end of the at least one lift arm, providing a forwardly facing surface on a front wall of the forward end of the at least one lift arm, providing a mounting plate, attaching a first coupler section to the first mounting plate, mounting the mounting plate on the forwardly facing surface of the front wall of the forward end of the at least one lift arm and extending one or more bosses on a back face of the mounting plate through an opening in the forwardly facing surface into the longitudinal passage of the at least one lift arm, connecting the mounting plate to the conduit adjacent the forward end of the at least one lift arm and securing the mounting plate to the forwardly facing surface of the at least one lift arm adjacent attachment mounting members at the forward ends of the lift arms so that the one or more bosses on the back face of the mounting plate extends through an aperture in the forwardly facing surface and the first coupler being placed in position for receiving a mating coupler section, thereby positioning the first coupler section laterally of the operator's cab.

* * * * *